United States Patent [19]

Falconieri

[11] Patent Number: 4,525,089

[45] Date of Patent: Jun. 25, 1985

[54] DOCUMENT FEED-IN DEVICE

[75] Inventor: Remo Falconieri, S. Giorgio Canavese, Italy

[73] Assignee: C. Olivetti & C., S.p.A., Ivrea, Italy

[21] Appl. No.: 463,493

[22] Filed: Feb. 3, 1983

[30] Foreign Application Priority Data

Feb. 3, 1982 [IT] Italy ..... 67123 A/82

[51] Int. Cl.[3] ..... B41J 13/02

[52] U.S. Cl. ..... 400/639.1; 400/640; 400/550

[58] Field of Search ..... 400/144.2, 637.1, 638, 400/639, 639.1, 639.2, 640, 645, 645.1, 645.2, 645.3, 645.4, 645.5, 705.4, 705.5, 550

[56] References Cited

U.S. PATENT DOCUMENTS

| | | | |
|---|---|---|---|
| 1,024,759 | 4/1912 | Woodward | 400/638 |
| 1,192,577 | 7/1916 | Smith | 400/639.1 X |
| 1,244,011 | 10/1917 | Anderson | 400/645.4 X |
| 1,682,333 | 8/1928 | Hart | 400/639.2 X |
| 1,900,102 | 3/1933 | Going | 400/639.1 X |
| 2,642,172 | 6/1953 | Felber | 400/705.5 X |
| 4,031,995 | 6/1977 | Blum et al. | 400/639.1 X |
| 4,211,499 | 7/1980 | Hunt et al. | 400/639.1 X |
| 4,215,945 | 8/1980 | Habich et al. | 400/639.1 X |
| 4,266,880 | 5/1981 | Buchanan | 400/639.1 X |
| 4,386,864 | 6/1983 | Wang et al. | 400/144.2 X |
| 4,407,591 | 10/1983 | Adamoli et al. | 400/124 X |

FOREIGN PATENT DOCUMENTS

| | | | |
|---|---|---|---|
| 0038216 | 10/1981 | European Pat. Off. | 400/570 |
| 666470 | 10/1938 | Fed. Rep. of Germany | 400/639.1 |
| 84885 | 5/1982 | Japan | 400/639.1 |
| 2030076 | 4/1980 | United Kingdom | 400/697.1 |

OTHER PUBLICATIONS

IBM Technical Disclosure Bulletin, "Power-Operated Paper Insert Automatically Utilizing Triple Pitch for Typewriter", Lennon, vol. 22, No. 2, Jul. 1979, pp. 661–663.

IBM Technical Disclosure Bulletin, "Automatic First Writing Line Mechanism", Sweat, Jr., vol. 23, No. 9, Feb. 1981, pp. 3961–3964.

*Primary Examiner*—Ernest T. Wright, Jr.

*Attorney, Agent, or Firm*—Banner, Birch, McKie & Beckett

[57] ABSTRACT

A document feed-in device for an electronic typewriter comprises a lower guide member for guiding a document towards a typing line on a platen cylinder and a plate or bar member for guiding the document beyond the typing line. The plate or bar member is carried by two movable levers for moving that member away from the platen cylinder and at the same time actuating a switch for signalling the presence of the document to the electronic control means of the machine, to cause rotation of the platen cylinder so that the document goes beyond the typing line by a predetermined distance such that the top edge of the document is moved into a region in which it is engaged by the plate or bar member to permit typing in a region immediately adjacent to the top edge of the document.

8 Claims, 7 Drawing Figures

AMPL
I/O
UC
MEM.
TAST.

DOCUMENT FEED-IN DEVICE

BACKGROUND OF THE INVENTION

The present invention relates to a document feed-in or introducing device, comprising a lower guide member for guiding a document towards a typing line on a platen cylinder, and a plate or bar member for guiding the document beyond the typing line.

Normally, in order to feed a document into a typewriter, the operator is required to perform a manual operation in order to guide the document towards the upper guide elements, to prevent any interference with the typing assembly, and correctly to position the document on the platen cylinder, aligning it with the typing line.

SUMMARY OF THE INVENTION

The technical problem which the present invention seeks to solve is that of providing a document feed-in device which is simple, reliable, quick, low in cost and very easy to use.

That problem is solved by the document feed-in device according to the invention, which is characterised by an actuating element which moves at least a part of said guide elements away from the platen cylinder and which acts on a switch to activate rotary motion of said platen cylinder so as to cause the document to be advanced beyond the typing line by a predetermined distance such that the top edge of the document is moved into a region in which it is engaged by said plate or bar member and which permits typing in a region immediately adjacent to the top edge of said document.

DESCRIPTION OF THE DRAWING

A preferred embodiment of the invention will now be described in the following description given by way of non-limiting example, with reference to the accompanying drawing in which.

DESCRIPTION OF THE ILLUSTRATED EMBODIMENT

Figure 1:
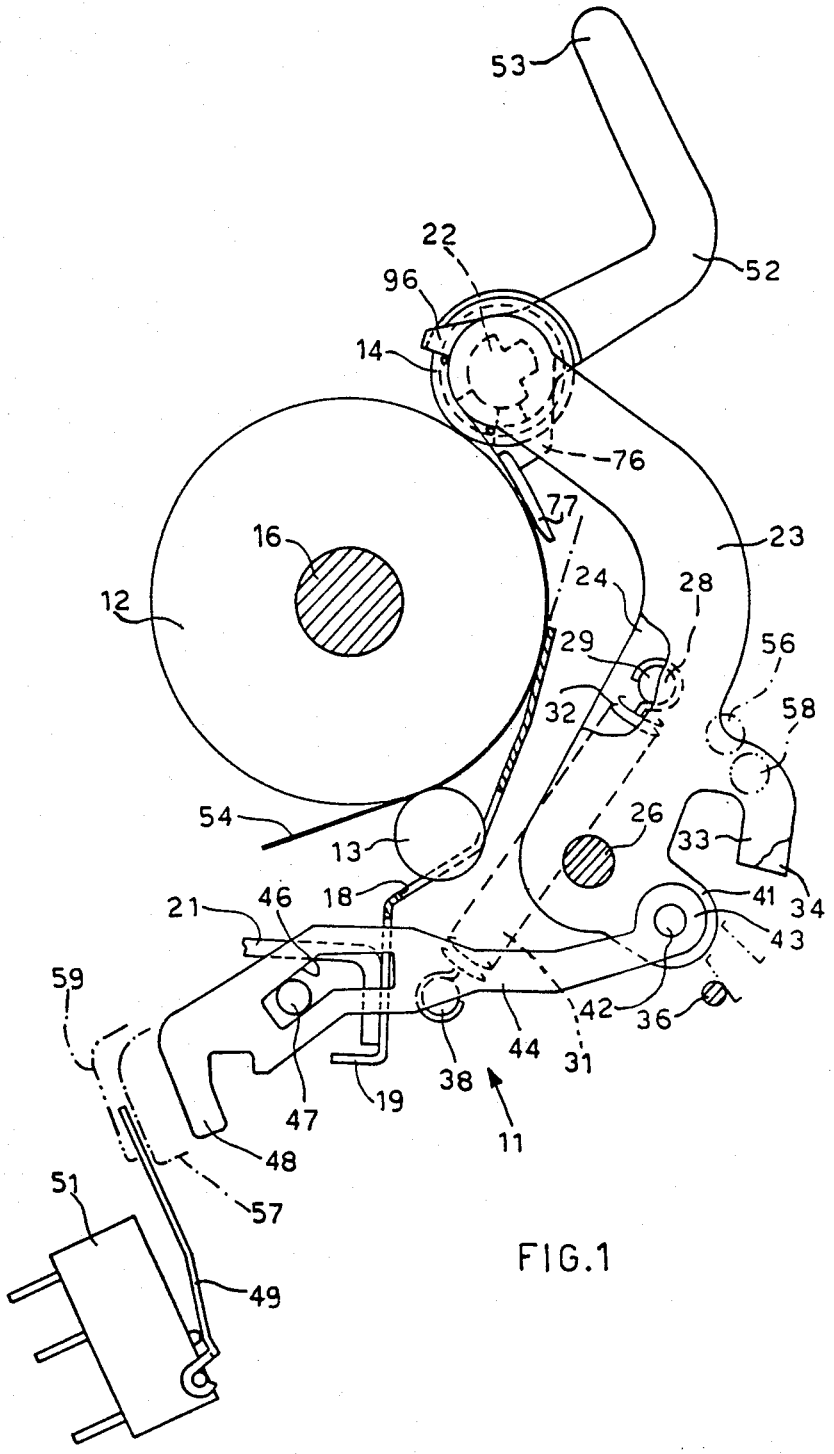
FIG. 1 shows a longitudinal view of part of the feed-in device according to the invention, applied for example to an electronically actuated typewriter.

The feed-in device according to the invention is suitable for being applied to a typewriter, an accounting machine, a terminal apparatus or similar typing or printing machines. In the embodiment described hereinafter, the document feed-in device which is generally indicated by reference numeral 11 (see FIG. 1) is used on a typewriter of electronic type, having the usual paper platen cylinder 12, lower paper pressure rolls 13 and upper paper pressure rolls 14.

The platen cylinder 12 is rotatable by a shaft 16, by means of an electric motor 17 (see FIG. 7) of a line spacer device which is not shown in the drawing but which is substantially similar to that described in the European patent application No. 81301650.8 filed on Apr. 14, 1981, now European Pat. No. 0,038,216 published Oct. 21, 1981.

The lower pressure rolls 13 (see FIG. 1) are supported in per se known manner and are received in slots 18 in a lower paper pressure plate or bar member or guide member 19, which is fixed to a support 21.

The upper pressure rolls 14 are mounted slidably on a conventional bar 22 which is fixed to two paper pressure levers, being a left-hand lever 23 and a right-hand lever 24, which are disposed at the ends of the bar 22. Each lever 23 and 24 is pivoted on a spindle 26 and 27 (see FIG. 2) and comprises a pin 28 and 29 co-operable with a spring 31 and 32 (see FIG. 1), and a limb portion 33 and 34 co-operable with a fixed abutment 36 and 37 (see FIG. 2). Each spring 31 and 32 (see FIG. 1) is fitted between the respective pins 28 and 29 of the levers 23 and 24, and fixed pins 38 and 39 (see FIG. 2) to rotationaly urge the respective lever 23 and 24 in an anticlockwise direction, with each lever 23 and 24 being in a position of abutment with the pressure rolls 14 (see FIG. 1) against the outside surface of the platen cylinder 12, when it is in the position shown in FIG. 1.

The left-hand pressure lever 23 comprises a second limb portion 41 which is connected by means of a pin or pivot 42 to a limb portion 43 of an actuating lever 44. The lever 44 has a suitably shaped slot 46 which is capable of being engaged by a fixed guide pin 47, and a lug portion 48 co-operable with a blade 49 of a switch 51 in a given operating position as described hereinafter.

The right-hand pressure lever 24 comprises an upwardly projecting arm 52 which terminates with a handle portion 53 such that it can be engaged by an operator for positioning the device 11 during the operation of introducing or feeding in a document or sheet of typing paper 54. The operator, by gripping the handle portion 53, causes the levers 23 and 24 to rotate in the clockwise direction against the force of the respective springs 31 and 32 until the pins 28 and 29 take up the position shown by the dash-dotted line indicated at 56. In position 56, the levers 23 and 24 are in an unstable position, with the springs 31 and 32 at the dead centre position, and the actuating lever 44 with the lug portion 48 reaches the position shown in dash-dotted lines at 57. In position 57, the lug portion 48 does not engage the blade 49 of the switch 51 and therefore does not actuate the switch 51. If the operator continues to rotate the levers 23 and 24 in the clockwise direction, as soon as the arrangement has moved beyond the position as indicated at 56, the springs 31 and 32 assist such rotary motion until the arrangement takes up the position shown by a dashed and double-dotted line at 58, in which the limb portions 33 and 34 bear against the respective fixed abutments 36 and 37 and the lug portion 48 of the actuating lever 44 is in position 59 indicated by dashed and double-dotted lines, in which it engages the blade 49 of the switch 51 and actuates the switch 51 to a closed position.

To return the levers 23 and 24 to the initial position, the operator rotates the levers 23 and 24 in the anticlockwise direction against the force of the springs 31 and 32 until the arrangement reaches the position indicated at 56 and, when the arrangement goes beyond that position, the springs 31 and 32 assist such rotary motion until the upper rolls 14 are stopped and held against the surface of the platen cylinder 12.

The switch 51 is connected to an input-output unit 61 (see FIG. 7) which is controlled by a central unit 62 connected to memories 63 and a keyboard 64. The input-output unit 61 controls the clockwise and anticlockwise rotation and stopping of the electric motor 17 by means of three lines 66, 67 and 68 and an amplifier 69, and receives the information relating to the opened and closed conditions of the switch 51, by means of a line 71.

The feed-in device 11 (see FIG. 1) comprises an upper guide member which is generally indicated at 76 and which is mounted on the bar 22 and the levers 23 and 24, thus being movable with the bar 22 and the levers 23 and 24. The upper guide member 76 comprises a plate or bar member 77 which is disposed parallel to the platen cylinder 12 and which has two supports 78 and 79 (see FIG. 2) at its ends. The supports 78 and 79 are co-operable with corresponding sleeve portions 81 and 82 on the respective levers 23 and 24, and two teeth 83 and 84 which can be received in corresponding seats 86 and 87 in the sleeve portions 81 and 82. The seats 86 and 87 (see FIG. 5) are defined by two shoulders 88 and 89 which are capable of delimiting rotary movement of the teeth 83 and 84 (see FIG. 2). Mounted on each sleeve portion 81 and 82 is a respective spring 91 and 92 having one end thereof, as indicated at 93 and 94, bearing against a shoulder or lug 96 and 97 on the respective sleeve portion 81 and 82, while the other end 98 and 99 of the respective springs 91 and 92 bears against an edge of the respective tooth 83 and 84 of the guide member 76. The two springs 91 and 92 are torsion type springs: one spring being right-handed and the other spring being left-handed, and being mounted in such a way that they normally urge the plate or bar member 77 in an anticlockwise direction and hold it in a condition of bearing with the teeth 83 and 84 against the shoulders 89 (see FIG. 6). In that way, the bar member 77 is held at a slight spacing from the outside surface of the platen cylinder 12, as shown in FIG. 6, for guiding the typing paper 54 and permitting it to pass between the outside surface of the platen cylinder 12 and the plate or bar member 77.

When the operator grips the handle portion 53 (see FIG. 1) to rotate the levers 23 and 24 in the clockwise direction to move the bar member 77 away from the platen cylinder 12, as described hereinbefore, after a rotary movement through about 30°, the bar member 77 comes to bear against a cover 101 (see FIG. 6) of a typing assembly (not shown in the drawing and similar to the cover of the typing assembly as described in the United Kingdom Pat. No. 2,030,076), as indicated in broken lines at position 102. If the operator continues to rotate the levers 23 and 24 in the clockwise direction, the cover 101 causes the bar member 77 to rotate in the clockwise direction against the force of the torsion springs 91 and 92 (see FIG. 2), so that it takes up the position as shown at 103 in FIG. 6 in dash-dotted lines, until it assumes the position indicated at 104 by dashed and double-dotted lines. When the bar member 77 is in the position indicated at 104, the levers 23 and 24 (see FIG. 1) are blocked with the limb portions 33 and 34 against the respective abutments 36 and 37, and the lug portion 48 is in the position 59 in which the switch 51 is closed, as described above. At that point, the operator introduces the sheet of paper or document 54 and, by means of keyboard actuation at 64 (see FIG. 7), the motor 17 receives an order and rotates the platen cylinder 12 (see FIG. 1) by a predetermined number of steps such as to position the sheet 54 as shown by the dash-dotted line in FIG. 1 and the continuous line in FIG. 6. In that position, the top edge of the sheet of paper 54 is just beyond the typing line. The operator now returns the levers 23 and 24 (see FIG. 1) to the original position, as described hereinbefore. During that rotary movement, the bar member 77 first assumes position 103 (see FIG. 6) and then position 102, due to the force of the torsion springs 91 and 92 (see FIG. 2). As soon as the bar member 77 leaves the position shown at 102 in FIG. 6, the lower edge thereof engages the top edge of the sheet of paper 54 and urges it towards the platen cylinder 12 until the bar member 77 is again in the position in which it bears against the shoulder 89. In that position, the sheet of paper 54 fits closely to the platen cylinder 12 and is in a position which permits typing to be done at the topmost edge of the sheet.

As will be clearly seen from the description, the described document feed-in device 11 (see FIG. 1) is particularly suitable when the operator or user is required to type immediately at the topmost edge of the sheet of paper 54, for example when a cheque is to be made out, in which the figure to be typed is adjacent to the top edge thereof. According to the various types of cheques, which vary from one bank to another, or other documents, the memory 63 (see FIG. 7) and the central unit 62 contain particularised information which, depending on the type of document, causes the motor 17 to rotate by a predetermined amount in order to position the top edge at the typing point.

The above-described document feed-in device 11 (see FIG. 1) is particularly suitable for being fitted to machines in which the typing assembly is carried by a movable carriage and is mounted very close to the platen cylinder (at 12). The typing assembly and the movable carriage are not described and are substantially similar to these described in the United Kingdom Pat. No. 2,030,076. That is the situation when the typing assembly comprises a "daisy wheel" type character carrier with flexible petals, as described in the United Kingdom Pat. No. 2,030,076 which was granted on 16th July 1982, or when the typing assembly is of a needle type, which is not described and is substantially similar to that described in the U.S. Pat. No. 4,407,591.

In the machine of the United Kingdom Pat. No. 2,030,076, in order for the top edge of the sheet of paper to fit closely to the platen of that machine and next to the typing line, and thus without using the upper pressure rollers, use has been made of a paper guide which occupies a fraction of the typing line and is mounted on the movable carriage of the typing assembly. The paper guide is provided with an aperture at the location of the typing assembly, to permit items to be typed. The above-indicated paper guide however has the disadvantage that the cheques or similar documents, either in the feed-in operation or during movement of the carriage, can catch against the edges of the aperture or the edges of the paper guide. That may occur, and jamming may happen, even when the edges are suitably inclined and shaped.

Figures 2, 3, 4, 5, 7:
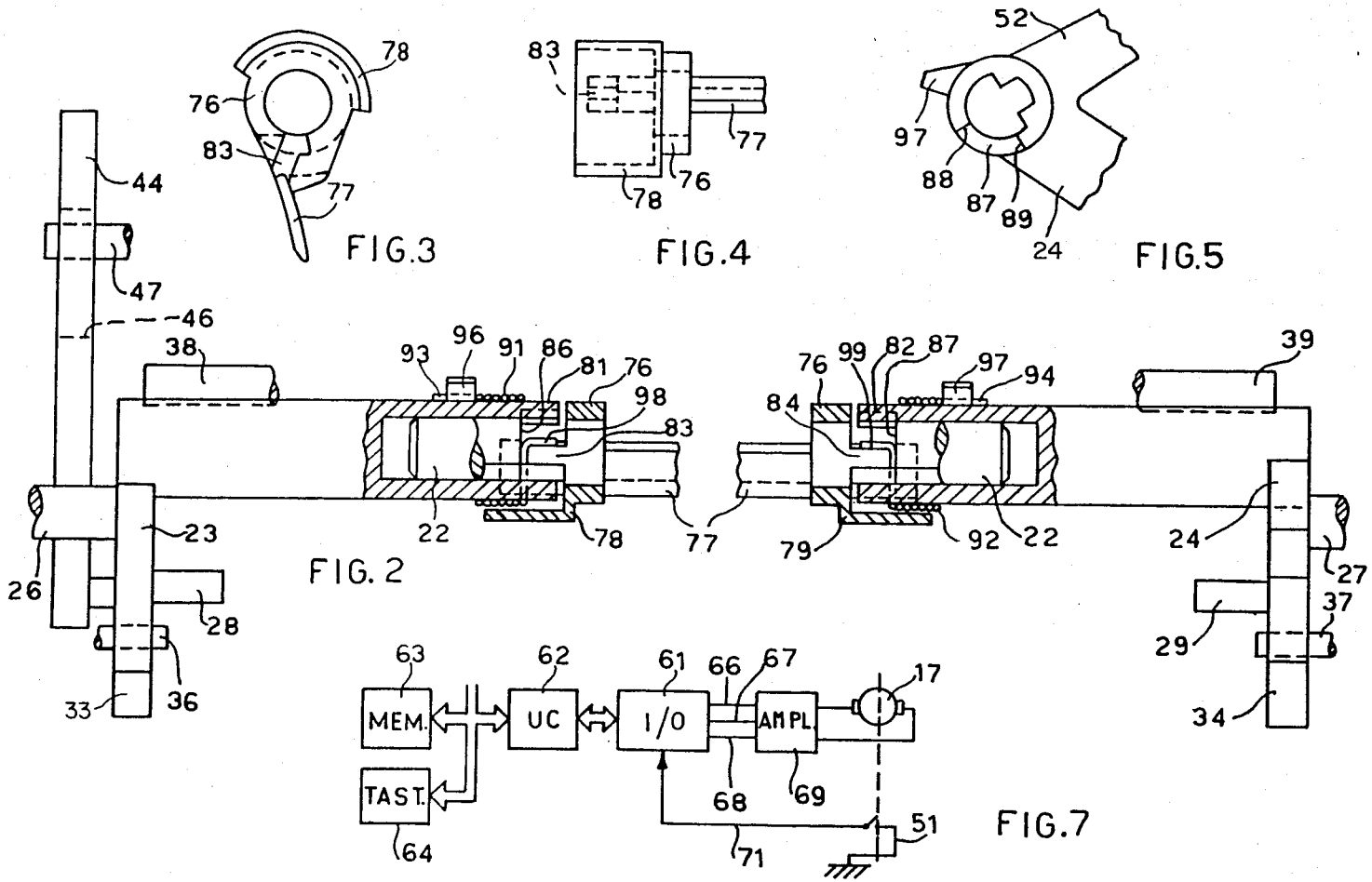
FIG. 2 shows a plan view of part of some detail components of FIG. 1.
FIG. 3 shows a longitudinal view of part of a detail of FIG. 1.
FIG. 4 shows a plan view of part of the detail shown in FIG. 3.
FIG. 5 shows a longitudinal view of part of another detail of FIG. 1.
FIG. 7 shows a logic block circuit diagram of a control and actuating unit of the machine shown in FIG. 1.
Figure 6:
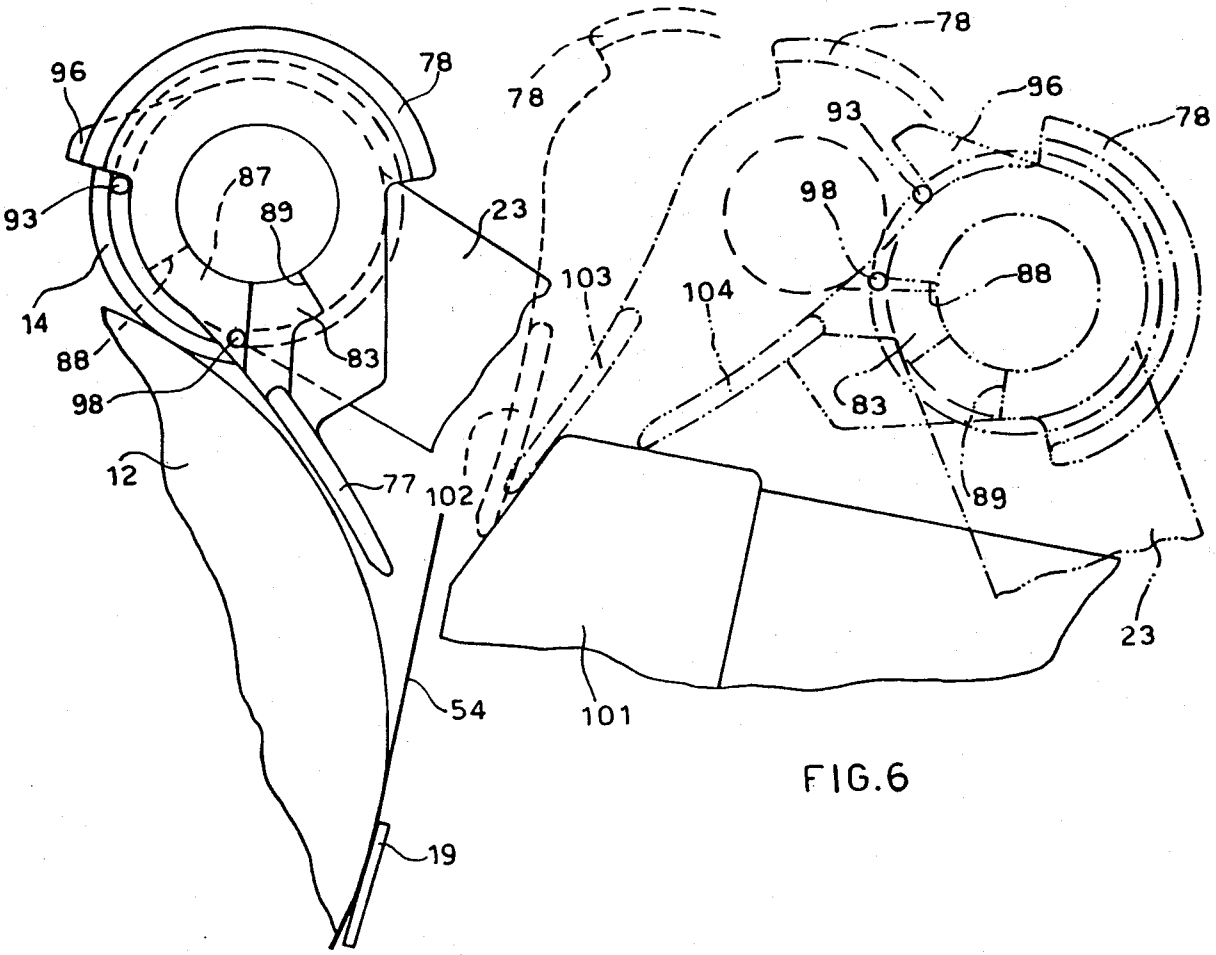
FIG. 6 shows a longitudinal view on an enlarged scale of part of the feed-in device shown in FIG. 1, in successive operating positions.

As can be clearly seen from FIG. 2, the plate or bar member 77 takes up the entire width of the platen cylinder 12 in its operating position (see FIG. 6), with its lower edge immediately above the typing line. During the movement of the carriage, there is no relative motion as between the plate or bar member 77 and the paper 54. During the feed-in phase, the plate or bar member 77, in its position 104, does not interfere with the top edge of the paper 54. By virtue of the camming configuration of the cover 101, being inclined with respect to the platen cylinder 12, the plate or bar member 77 in its position 102 has its lower edge below the top edge of the paper 54 and it is only from that position 102 that the plate or bar member 77 will be able to engage the top edge of the cheque 54, to position it adjacent to the platen cylinder 12. That therefore avoids any possibility of jamming or sticking as between the plate or bar member 77 and the paper 54.

It will be apparent that the document feed-in device described hereinbefore may be the subject of various modifications and additions of parts, without thereby departing from the scope of the present invention.

What I claim is:

1. A document feed-in device comprising a paper platen cylinder which defines a typing line and supports a document; a lower guide member for guiding the document towards the typing line on the paper platen cylinder; guide elements for guiding the document beyond the typing line and for holding the document in a position of fitting closely to the paper platen cylinder; a switch operable for activating rotary movement of the paper platen cylinder in such a way as to advance a top edge of document closely beyond the typing line, and wherein the guide elements permit typing in a region immediately adjacent the top edge of the document; and actuating element for moving at least a part of the guide elements away from the paper platen cylinder and connecting means operating in response to the movement of said part of the guide elements on said switch; wherein said guide elements comprise: an axis member; a series of paper pressure rolls rotatable and slidable on said axis member for cooperating with said document; two levers for supporting said axis member, wherein said two levers are movable from a first position in which the series of paper pressure rolls are adjacent the paper platen cylinder to a second position in which the series of paper pressure rolls are spaced from the paper platen cylinder to permit the document to be introduced; a bar member which is pivoted on said axis member parallel to the paper platen cylinder wherein the bar member is movable from an abutment position in which the bar member is arrested against an arrest on the two levers to a free position in which the bar member is away from said arrest; torsion spring means for holding the bar member in said abutment position against the arrest on the two levers; wherein said bar member comprises a portion for guiding the top edge of said document toward said paper pressure rolls and wherein said portion of the bar member is parallel to the paper platen cylinder in the abutment position of said bar member and in the first position of said levers; and cam means disposed adjacent the paper platen cylinder and cooperative with the bar member for holding the bar member in the free position against the action of the torsion spring means when the two levers are positioned in said second position and wherein a lower edge of said bar member, in said free position, engages said document for urging the top edge of the document on said paper platen cylinder closely beyond the typing line when the two levers are returned from said second position to said first position.

2. A document feed-in device according to claim 1, wherein the bar member extends substantially over the entire length of the paper platen cylinder, wherein said bar member carries two shoulders at its ends and wherein said two levers are both provided with said arrest capable of cooperating with the corresponding shoulders of the bar member.

3. A document feed-in device according to claim 1, wherein said actuating element actuates said switch through said connecting means when said two levers are moved into said second position.

4. A document feed-in device according to claim 3, further comprising bistable spring means operative on said two levers, wherein said spring means causes the series of paper pressure rolls to bear against the paper platen cylinder in the first position of said two levers and wherein said spring means holds said two levers in their second position arrested agaist fixed abutments.

5. A document feed-in device according to claim 4, wherein said part comprises one of said two levers and wherein said connecting means comprise an actuating lever to actuate said switch when said two levers are in said second position.

6. A document feed-in device according to claim 5, wherein said switch is mounted on an electronically actuated typewriter and said document is a cheque.

7. A document feed-in device for typing machines comprising a platen cylinder which defines a typing line and supports a document; a lower guide member for guiding the document toward the typing line; a bar member having a guide portion for guiding an upper part of said document beyond the typing line; a support for pivotally supporting said bar member; means for moving said support between an operative position and an inoperative position, wherein said support in its operative position holds the bar member adjacent the platen cylinder and wherein said support in its inoperative position holds the bar member spaced from the platen cylinder to permit said document to be introduced; and means operative on said bar member for causing a top typing line of the document to be very close to a topmost edge of said document, wherein said means operative on said bar member comprise:

spring means for urging said bar member towards said platen cyliner; arrest means on said support for arresting said bar member into a guide position causing said guide portion to be substantially parallel to said platen cylinder and close to said platen cylinder in the operative position of said support; and cam means adjacent the platen cylinder and disposed in the path of the bar member for modifying the inclination of the guide portion of said bar member from said position parallel to the platen cylinder to a position coincident with said upper part of the document, wherein said bar member cooperates with said cam means, against the action of said spring means, in response to the movement of said support from said operative to said inoperative position for being positioned into said position coincident with said upper part of the document in order to improve the engagement of the upper part of said document with a lower edge of said bar member.

8. A document feed-in device according to claim 7, wherein said bar member has a length substantially equal to the entire length of the platen cylinder.

* * * * *